United States Patent [19]

Prickett

[11] Patent Number: 4,901,212

[45] Date of Patent: Feb. 13, 1990

[54] RAPIDLY ADJUSTABLE DECORATIVE EXTERIOR TRIM LIGHTING SYSTEM

[76] Inventor: Robert B. Prickett, 3816 Mockingbird La., Dallas, Tex. 75205

[21] Appl. No.: 297,754

[22] Filed: Jan. 17, 1989

[51] Int. Cl.[4] ..... F21S 1/02

[52] U.S. Cl. ..... 362/145; 362/227; 362/249; 362/250; 362/392; 362/806

[58] Field of Search ..... 362/121, 122, 123, 145, 362/147, 151, 152, 227, 249, 250, 252, 806, 807, 808, 810, 396, 392, 393

[56] References Cited

U.S. PATENT DOCUMENTS

| | | | |
|---|---|---|---|
| 2,723,818 | 11/1955 | Hurtzig | 248/106 |
| 3,182,944 | 5/1965 | Laviano | 248/226 |
| 3,189,310 | 6/1965 | Trueson | 248/314 |
| 3,193,229 | 7/1965 | Stock | 362/396 |
| 3,341,699 | 9/1967 | Somermeyer | 240/2 |
| 3,540,687 | 11/1970 | Cuva | 248/316 |
| 3,559,918 | 8/1971 | Patchett | 248/215 |
| 3,578,282 | 5/1971 | Olsen | 362/396 |
| 3,584,795 | 6/1971 | Baird | 362/396 |
| 3,596,859 | 8/1971 | MacDonald | 362/396 |
| 3,861,632 | 1/1975 | Siilats | 248/223 |
| 3,883,926 | 5/1975 | Reynolds | 24/73 |
| 3,970,837 | 7/1976 | Helm | 240/52.15 |
| 4,128,863 | 12/1978 | Premetz | 362/249 |
| 4,214,688 | 7/1980 | Griffin, Jr. | 362/396 |
| 4,482,944 | 11/1984 | Roossine et al. | 362/250 |
| 4,491,902 | 1/1985 | Cangelosi | 362/389 |
| 4,661,891 | 4/1987 | Kitamura | 362/219 |
| 4,714,219 | 12/1987 | Mayse | 248/65 |
| 4,774,646 | 9/1988 | L'Heureux | 362/145 |

*Primary Examiner*—Charles J. Myhre
*Assistant Examiner*—Sue Hagarman
*Attorney, Agent, or Firm*—Hubbard, Thurman, Turner, Tucker & Harris

[57] ABSTRACT

A decorative trim lighting system comprises an elongated, extruded plastic retaining strip which is formed in a laterally folded configuration and is adhesively securable along an exterior edge portion of a building. A series of support tab members are insertable between the folded side portions of the retaining strip, at longitudinally spaced intervals along the strip, and are frictionally gripped and retained by the facing side portions of the strip. The tabs have outer end portions which support the light elements of a decorative light string along the building portion edge. The retaining strip may be left in place on the building when the light string and associated support tabs are removed, and permits rapid and easy reinstallation of the light string. Additionally, the spacing between the individual light elements may be easily adjusted simply by sliding their support tabs along the length of the retaining strip.

14 Claims, 1 Drawing Sheet

RAPIDLY ADJUSTABLE DECORATIVE EXTERIOR TRIM LIGHTING SYSTEM

BACKGROUND OF THE INVENTION

The present invention relates generally to decorative trim lighting systems and, in preferred embodiments thereof, more particularly provides significantly improved exterior trim lighting support structure for mounting decorative light "strings" (such as those typically used during the Christmas holiday season) along various exterior edge portions of buildings.

It is a well known practice to "trim" exterior building edges, such as eaves, rain gutters, roofs and windows, with decorative light strings comprising a series of bulb and socket structures secured at spaced intervals to a length of electrical power supply wiring. A variety of methods have been employed to support the light strings along the building edges which they are to decoratively illuminate. A now common scheme is to provide individual socket supporting members which may be screwed, nailed, clamped or otherwise secured in a predetermined, mutually spaced orientation around the particular building edge. Once these individual support elements are fastened into place, the bulb and socket portions of one or more light strings are suitably secured thereto.

Particularly when the building edge to be illuminatingly trimmed in this manner is relatively lengthy, the initial installation of the spaced socket support members is a laborious process since each support member must, for example, be individually screwed into place along the building edge. Additionally, for aesthetic symmetry in the resulting lighting array, care must be exercised to evenly space the individually attached support members. And, of course, care must also be exercised so that the spacing between any adjacent pair of support members is not greater than the socket-to-socket spacing on the light string to be installed.

Moreover, once this multiplicity of discrete socket support members is initially installed, it is also in most instances a rather tedious undertaking to adjust the relative spacing therebetween to establish a shorter or longer uniform distance between adjacent support members to thereby vary the number of string light elements positioned along the particular building edge.

In an attempt to simplify both the initial installation, and subsequent light-to-light spacing adjustments, of string lights in this orientation it has recently been proposed to provide generally plate-like socket support members which may be frictionally wedged between roof shingles and secured to individual light string sockets. While this support technique provides, in many instances, significant cost savings and reduced installation time, it is not without its own limitations.

For example, this type of string light support structure is, as a practical matter, only usable in conjunction with shingled roofs or with other building "layers" between which the individual support members may be wedged. To decoratively light-trim other portions of a building, other types of known light string support structures must be used.

Additionally, the efficacy of this support system depends to a large extent on the closeness of individual pairs of vertically adjacent roof shingles. Missing, broken or bent shingles at a desired roof connection location can require undesirable longitudinal adjustment of the light array, or the use of other types of attachment members at these less than ideal roof locations. Further, wind lifting of the shingles can easily dislodge one or more of the frictionally secured light element support members.

In view of the foregoing, it is an object of the present invention to provide an improved, rapidly adjustable decorative exterior trim ligthing system which eliminates or minimizes the above-mentioned problems, limitations and disadvantages typically associated with conventional string light support systems.

SUMMARY OF THE INVENTION

Figure 1:
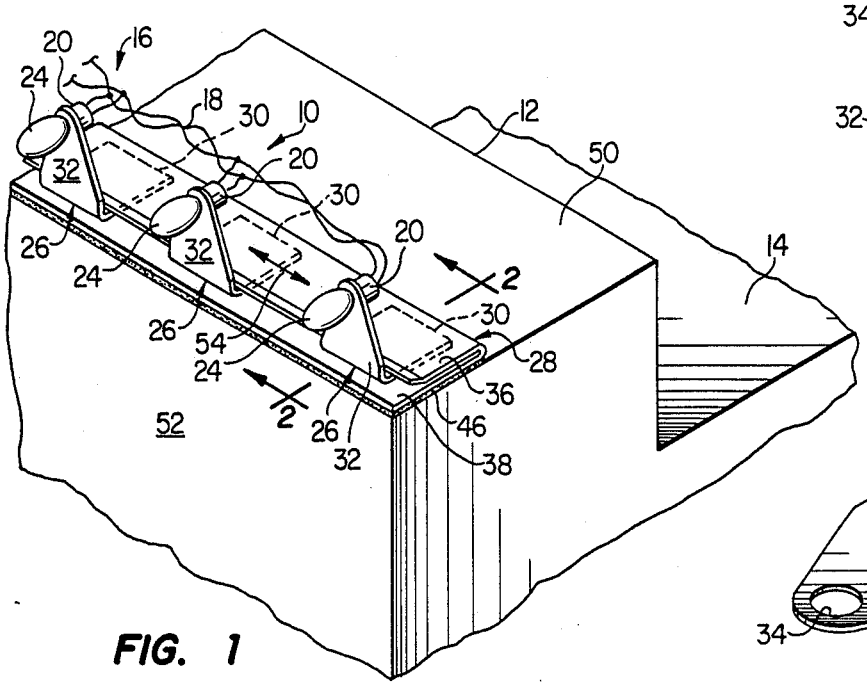
FIG. 1 is a perspective view of a roof parapet to which an exterior trim lighting system of the present invention is operatively secured.

In carrying out principles of the present invention, in accordance with a preferred embodiment thereof, a decorative exterior trim lighting system incorporates one or more conventional light strings and includes a series of socket and bulb support tab members and an elongated tab retaining strip. Each of the support tabs is of an elongated, generally rectangular configuration and is conveniently formed from a suitable plastic material. Through one end of each tab a circular opening is formed, the opening being sized to receive the lamp base portion of one of the string lights positioned on the tab. The inserted lamp base is received in its associated socket positioned on the other side of the tab to firmly secure each of the string lights to its associated support tab.

The retaining strip is preferably of an extruded plastic construction and has a laterally folded configuration in which the free side edge of a first lateral portion of the strip is spaced inwardly from the free side edge of a second lateral portion of the strip. Prior to the operative retaining use of the strip, these first and second lateral strip portions are resiliently held in close side-to-side adjacency by the longitudinally extending bent portion of the strip which interconnects the facing lateral portions thereof. The outer side of the second lateral strip section is coated with a suitably strong, weatherproof adhesive bonding material which may be protected prior to the installation of the strip with a length of peel-off paper or the like.

In installing the trim lighting system of the present invention, the protective paper is peeled away from the strip, and the adhesive side of the strip is firmly pressed against and along an exterior edge portion of a building to be decoratively illuminated. Alternatively, a suitable adhesive material may be applied to the building edge, or the strip, just prior to strip installation.

With the strip in place, end portions of the support tabs opposite their light and socket attachment ends are inserted into the space, or "pocket" between the facing lateral portions of the strip, at selected intervals along the length of the strip, so that the tabs extend transversely to the strip and are frictionally retained therein. Such tab insertion is conveniently performed after the string lights have been secured to the tabs, but if desired the tabs can be inserted into the strip before the lights are attached to the tabs. To facilitate tab insertion, the free edge of the first lateral strip portion is formed with a slight outward bend relative to the second lateral strip portion.

The use of the elongated resilient retaining strip permits rapid and very easy installation of one or more light strings along the length of an exterior building edge without the previous necessity of laboriously attaching a series of individual brackets, clips or the like directly to the building at predetermined intervals thereon. The simple light element retaining tabs frictionally held by the strip may be initially secured thereto in any desired spacing interval, and such spacing interval may be rapidly altered simply by sliding various ones of the frictionally retained tabs along the length of the strip.

Additionally, the use of the retaining strip advantageously permits the tabs to be used on building portions other than shingled roof areas. There is simply no need to have building "layers" (such as shingles, wood shakes and the like) to wedge the tabs between. Further, uniformly along its length the retaining strip creates and maintains a positive frictional grip on the tabs—regardless of where the tabs are moved along the length of the retaining strip.

Removal of the supported light string or strings from the building is also very quick and easy—all that is necessary is to pull the tabs outwardly from the strip. The tabs conveniently remain with the light string, and the strip is simply left in place on the building edge for subsequent light string installation thereon.

DETAILED DESCRIPTION

Perspectively illustrated in FIG. 1 is a portion of a decorative exterior trim lighting system 10 which incorporates principles of the present invention and is utilized to decoratively illuminate an edge portion of a building such as a parapet 12 that borders the building's roof 14. The trim lighting system 10 incorporates a conventional decorative light string 16 (such as that typically used during the Christmas holiday season) which includes a length of dual lead electrical power supply wiring 18 to which a series of light sockets 20 are operatively secured at spaced intervals along its length. The sockets 20 removably receive base portions 22 (FIG. 2) of bulbs 24.

Figure 4:
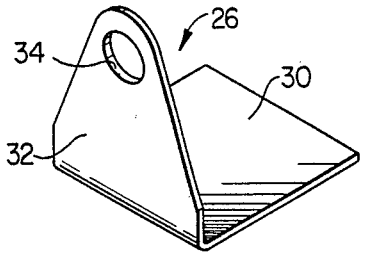
FIG. 4 is a perspective view of one of the light element support members used in the trim lighting system of FIG. 1.
Figure 2:
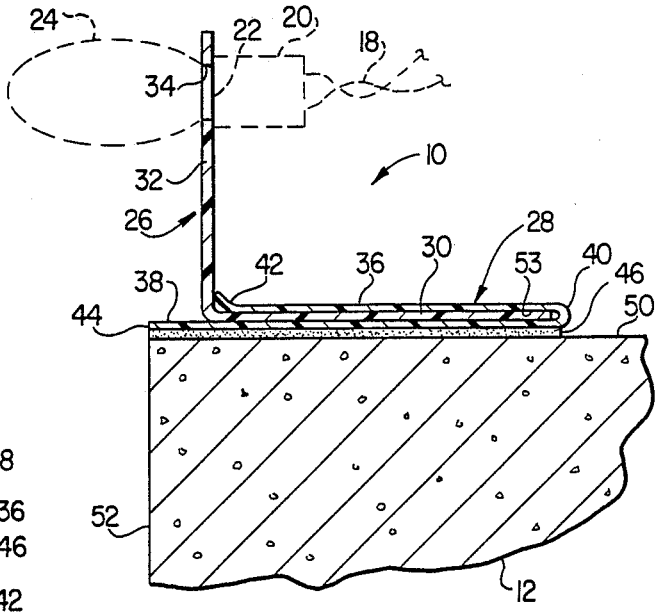
FIG. 2 is an enlarged scale system, cross-sectional view through the parapet, and the trim lighting system, taken along line 2—2 of FIG. 1, the thicknesses of various components of the lighting system being somewhat enlarged for illustrative clarity.

Referring now to FIGS. 1, 2 and 4, the trim lighting system 10 includes a unique light string support structure which comprises a series of elongated, generally rectangular plastic support tabs 26, and an elongated, extruded plastic support tab retaining strip 28. Each of the tabs 26 has an elongated base portion 30, and an upturned, generally triangularly configured end portion 32 with a circular opening 34 formed therethrough. The sockets and bulbs 20, 24 are attached to the upturned tab end portions 32 by inserting the bulb bases 22 rightwardly through the tab openings 34 and operatively securing the bases 22 within the sockets 20 positioned on the opposite sides of the tab portions 32 as best illustrated in FIG. 2. The tab openings 34 are smaller than either the sockets 20 or the bodies of the bulbs 24 so that the bulbs and sockets are securely held on the upturned tab ends when connected thereto in the illustrated manner.

Figure 3:
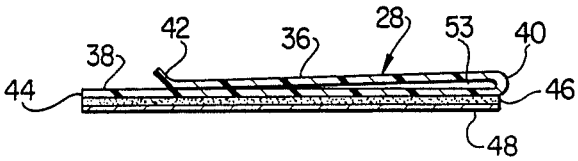
FIG. 3 is a cross-sectional view through a resilient support bracket retainer strip portion of the trim lighting system prior to the insertion of light element support members thereinto, the thicknesses of various portions of the strip structure being somewhat enlarged for illustrative clarity.

Referring now to FIGS. 2 and 3, the tab retaining strip 28 is formed in a laterally folded configuration defined by a first lateral strip portion 36 which, in the pre-operative position of the strip 28 illustrated in FIG. 3, closely overlies a somewhat wider second lateral strip portion 38. In this preoperative position of the strip 28, the lateral strip portion 36 is resiliently held against the underlying lateral strip portion 38 by a curved joining section 40 of the strip which interconnects the laterally facing strip portions 36, 38 along their right edges. The free edge 42 of strip portion 36 is spaced inwardly from the free edge 44 of strip portion 38 and, for purposes subsequently described, is preferably upturned relative to the strip portion 38.

The bottom side of the lower lateral strip portion 38 is coated with a suitably strong, weatherproof adhesive bonding material 46 which, prior to the initial installation of the strip 28, may be conveniently covered with a length of protective, peel-away paper 48 (FIG. 3). The retaining strip 28 may be fabricated in individual, essentially straight sections of suitable lengths, or may be provided in a continuous, coiled configuration. Also, if desired, the adhesive material 46 could be applied to the underside of the strip portion 38, or to the parapet, just prior to the installation of the strip 28 on the parapet 12 in a manner which will now be described.

To install the strip 28 on the parapet 12, the strip is extended along the upper surface 50 of the parapet closely adjacent its outer side surface 52. With its adhesive-protecting cover strip 48 peeled away, the strip 28 is then pressed firmly against the upper parapet surface 50 to permanently secure the strip 28 to the parapet via the adhesive bonding material 46.

With the retaining strip 28 installed on the parapet in this manner, and the sockets and bulbs 20, 24 attached to the tab end portions 32 as previously described, the base portions 30 of the tabs are simply pressed transversely into the space or "pocket" 53 (FIG. 3) between the upper and lower lateral strip portions 36 and 38 at selected longitudinal intervals along the retaining strip 28 (see FIGS. 1 and 2). This insertion of the tab bases into the retaining strip pocket 53 is facilitated by the upturned strip edge 42, and upwardly deflects the lateral strip portion 36 at the various tab locations to thereby frictionally retain the tab base portions 30 within the retaining strip 28 as illustrated in FIGS. 1 and 2. In this very simple manner, the illustrated light string 16 may be very rapidly secured along the outer top edge of the parapet 12.

The longitudinal spacing intervals between the individual lights which border the parapet edge may be rapidly adjusted simply by sliding the frictionally retained tabs 26 lengthwise along the retaining strip 28 as indicated by the double-ended arrow 54 in FIG. 1. Thus, any desired light-to-light spacing array (limited only by the length between adjacent socket pairs on the wiring 18) can be achieved by such sliding movement of the tabs 26. In sharp contrast to conventional series of discrete attachment elements secured to the building, such spacing intervals are not fixed by the initial placement of the light string support structure.

The removal of the light string 16 is just as rapid and easy. All that is necessary to remove the light string from the parapet 12 is to pull the tabs 26 outwardly from the retaining strip 28. The removed tabs 26 conveniently remain attached to the individual light elements to facilitate rapid re-installation of the light string on the parapet when desired. After removal of the light string and the tabs 26, the retaining strip 28 is simply left in place in readiness for subsequent light string support duty.

Figure 5:
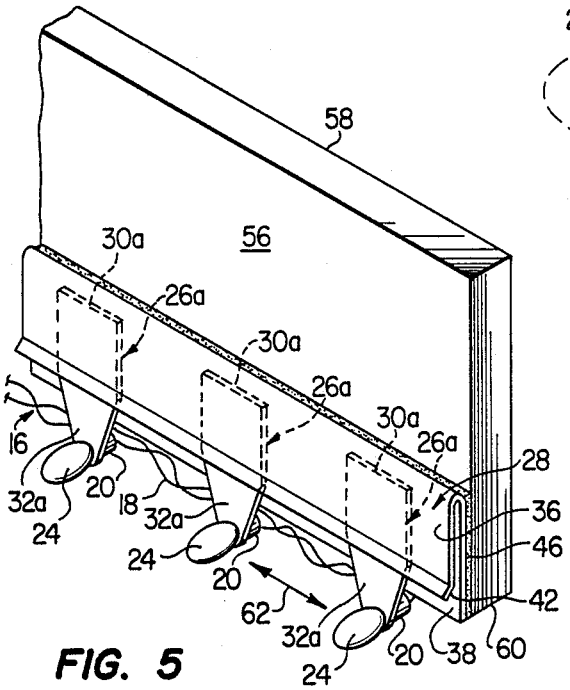
FIG. 5 is a perspective view of an alternative embodiment of the trim lighting system representatively secured to a building eave.

While the trim lighting system 10 may be used, as representatively illustrated in FIGS. 1 and 2, to support one or more light strings 16 on a roof parapet structure, the usefulness of the retaining strip 28 and its associated light element support tabs 26 is in no manner limited to roof edge installations. As but one example of the flexibility of the trim lighting system 10, a slightly modified embodiment $10_a$ is illustrated in FIG. 5 as being connected to a side surface 56 of an eave portion 58 of a building.

Figure 6:
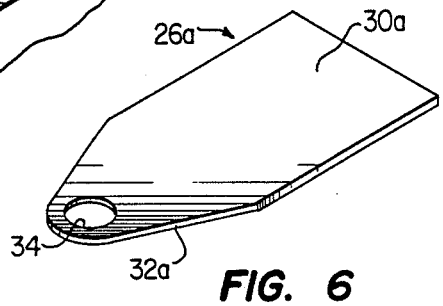
FIG. 6 is a perspective view of a representative alternate embodiment of the FIG. 4 light element support member which is used in the trim lighting lighting system of FIG. 5.

In the alternate trim lighting system embodiment $10_a$, the retaining strip 28 is adhesively secured to the vertical side surface 56 of the eave 58, adjacent its lower edge 60, as previously described in conjunction with the parapet 12. The plastic support tabs $26_a$ (see FIG. 6) used in this trim lighting system embodiment are similar to the previously described tabs 26, except that their generally triangularly configured end portions $32_a$ are not angled relative to their base portions $30_a$—i.e., the tabs $26_a$ are essentially straight.

After the retaining strip 28 has been adhesively secured to the eave surface 56, and the sockets and bulbs 20, 24 have been attached to the tab ends $32_a$, the tab base portions $30_a$ are simply inserted upwardly between the retaining strip lateral portions 36 and 38, at suitable longitudinal intervals along the length of the strip 28, to frictionally retain the tabs $26_a$ on the strip 28 and conveniently position the bulbs 24 somewhat below the lower eave edge 60. In a manner similar to that described in conjunction with the trim lighting system 10, the spacing intervals between the tabs $26_a$ (and thus the intervals between the bulbs 24) may be rapidly adjusted simply by sliding the tabs $26_a$ along the strip 28 as indicated by the double-ended arrow 62 in FIG. 5.

Removal of the eave-supported light string 16 is effected in the same manner as described in conjunction with the parapet-mounted system 10—the tabs $26_a$ are simply pulled downwardly out of the retaining strip 28 and are conveniently left attached to their associated sockets 20 and bulbs 24. With the light string 16 and the tabs $26_a$ removed in this manner, the eave-mounted retaining strip 28 is left in place for subsequent attachment thereto of the tabs $26_a$ and the light string 16 attached thereto.

It can be seen from the foregoing that the present invention indeed provides an improved exterior decorative trim lighting system which allows one or more light strings to be rapidly and easily mounted on an exterior edge portion of a building, and just as easily removed therefrom. The lighting system provides for very easy adjustment of the light element spacing intervals, either at the initial installation of the light string or thereafter. The support structure portion of the overall trim lighting system is easily and quite inexpensively manufactured from weatherproof plastic material of rather rugged construction. The previously rather laborious task of mounting decorative light strings on selected exterior edge portions of buildings may now be more easily and rapidly accomplished, and requires no tools to do so.

The foregoing detailed description is to be clearly understood as being given by way of illustration and example only, the spirit and scope of the present invention being limited solely by the appended claims.

What is claimed is:

1. Adjustable apparatus for supporting a light string along a surface to be decoratively illuminated, said light string including a length of electrical power supply wiring, a series of bulb sockets operatively secured to said electrical power supply wiring at spaced locations along its length, and a series of light bulbs with base portions adapted to be removably inserted into said sockets, said apparatus comprising:

a series of support members each having a base portion secured to a bulb and socket attachment portion;

means for removably mounting each of said bulb sockets, and its associated light bulb, on a different one of said bulb and socket attachment portions of said support members; and elongated retaining strip means, laterally securable to said surface to extend lengthwise therealong, for frictionally and releasably engaging and supporting said base portions of said support tab members at predetermined spacing intervals along the length of said retaining strip means in a manner permitting said support members to be slidingly moved along the length of said retaining strip means to selectively vary said spacing intervals, said elongated retaining strip means having, along essentially their entire length, an internal pocket into and from which said base portions of said support members may be inserted and withdrawn in directions generally parallel to the width of said elongated retaining strip means, said elongated retaining strip means further having a laterally folded configuration defined by a pair of facing side wall portions extending along opposite sides of said pocket and resiliently biased toward side-by-side contact by a joining section extending along a interconnecting aligned edge portions of said facing side wall portions, whereby longitudinal sections of said facing side wall portions are moved laterally apart from one another by insertion into said pocket of one of said support member base portions and frictionally grip opposite surfaces of the inserted base portion.

2. The apparatus of claim 1 wherein:

said elongated retaining strip means are defined by a plastic extrusion.

3. The apparatus of claim 1 wherein:

said support members are support tabs having relatively thin, plate-like configurations.

4. The apparatus of claim 3 wherein:

said bulb and socket attachment portions comprise end portions of said support tabs, and said means for removably mounting include openings formed through said end portions and sized to permit insertion of said light bulb base portions therethrough into said bulb sockets.

5. The apparatus of claim 4 wherein:

said end portions of said support tabs are angled relative to the base portions of said support tabs.

6. The apparatus of claim 1 further comprising:

adhesive means, extending along an outer side surface of said elongated retaining strip means, for bonding said elongated retaining strip means to said surface to be decoratively illuminated.

7. Apparatus for adjustably supporting a series of electrical light elements along an exterior edge portion of a building in a mutually spaced array, said light elements having secured thereto support members with tab-like base portions, said apparatus comprising:

an elongated retaining strip member formed from a resilient material and having a laterally folded configuration defined by facing first and second side wall portions interconnected along first aligned edge portions thereof by a joining section of said strip member which resiliently biases said side wall portions generally toward face-to-face contact with one another, said facing first and second side wall portions defining therebetween a pocket bounded at one edge of said strip member by said joining section and adjacent the opposite edge of said strip member by second, free edge portions of said first and second side wall portions, said retaining strip member being configured in a manner such that when said base portions of said support members are pushed between said free edge portions transversely into said pocket said first and second side wall portions frictionally grip the inserted base portions, to firmly support the same, and permit them to be slidingly moved longitudinally along said retaining strip member to selectively and rapidly adjust the spacing intervals between the inserted base portions; and means for securing said second side wall portion of said retaining strip member to and along said building exterior edge portion.

8. The apparatus of claim 7 wherein:

said means for securing include means for adhesively bonding said second side wall portion of said retaining strip member to said building exterior edge portion.

9. The apparatus of claim 8 wherein:

said means for adhesively bonding include a layer of weatherproof adhesive bonding material applied to the outer side surface of said second side wall portion of said retaining strip member.

10. The apparatus of claim 7 wherein:

said electrical light elements are the bulb and socket portions of a decorative light string, and said retaining strip member is a plastic extrusion.

11. The apparatus of claim 7 wherein:

said free edge portion of said first side wall portion of said retaining strip member is spaced inwardly of the free edge of said second side wall portion of said retaining strip member.

12. The apparatus of claim 11 wherein:

said retaining strip member is a plastic extrusion.

13. The apparatus of claim 11 wherein:

said free edge portion of said first side wall portion of said retaining strip member is turned outwardly relative to said second side wall portion of said retaining strip member.

14. The apparatus of claim 13 wherein:

said retaining strip member is a plastic extrusion.

* * * * *